US012760979B2

(12) United States Patent
Vitulli

(10) Patent No.: US 12,760,979 B2
(45) **Date of Patent: *Oct. 13, 2026**

(54) MODULAR FIREARM TRIGGER SYSTEM

(71) Applicant: Brandon Vitulli, Thomasville, GA (US)

(72) Inventor: Brandon Vitulli, Thomasville, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/265,386

(22) Filed: Jul. 10, 2025

(65) Prior Publication Data

US 2025/0347485 A1 Nov. 13, 2025

Related U.S. Application Data

(63) Continuation of application No. 18/661,841, filed on May 13, 2024, now Pat. No. 12,379,178.

(51) Int. Cl.
*F41A 19/10* (2006.01)
*F41A 19/15* (2006.01)
*F41C 23/10* (2006.01)

(52) U.S. Cl.
CPC ..... *F41A 19/15* (2013.01); *F41A 19/10* (2013.01); *F41C 23/10* (2013.01)

(58) Field of Classification Search
None
See application file for complete search history.

(56) References Cited

U.S. PATENT DOCUMENTS 2,457,296 A * 12/1948 Yawman ..... F41A 19/10 42/69.01
5,822,903 A * 10/1998 Davis, Sr. ..... F41A 19/16 42/70.07
6,164,001 A * 12/2000 Lee ..... F41A 19/17 42/69.01
6,298,594 B1 * 10/2001 Strayer ..... F41A 19/10 D22/108
7,010,878 B1 * 3/2006 du Plessis ..... F41A 19/10 42/69.01
9,052,149 B2 * 6/2015 Bender ..... F41A 19/10
9,410,760 B2 * 8/2016 Siddle ..... F41A 19/12
11,248,869 B2 * 2/2022 Lopata ..... F41A 19/10
11,274,895 B2 * 3/2022 Niswander ..... F41A 19/10
12,111,126 B2 * 10/2024 McNamee ..... F41A 19/10
12,584,706 B2 * 3/2026 Shank ..... F41A 19/10
2012/0117841 A1 * 5/2012 Joubert ..... F41A 19/16 42/69.01
2013/0269233 A1 * 10/2013 Chin ..... F41A 19/15 42/69.01
2018/0238647 A1 * 8/2018 Hudson, III ..... F41A 19/10
2019/0041150 A1 * 2/2019 Lopata ..... F41A 19/10
2019/0137206 A1 * 5/2019 Lopata ..... F41A 19/10
2024/0035767 A1 * 2/2024 Smathers ..... F41A 9/70
2024/0035777 A1 * 2/2024 Smathers ..... F41A 19/38

* cited by examiner

*Primary Examiner* — Derrick R Morgan

(74) *Attorney, Agent, or Firm* — J. Wiley Horton

(57) ABSTRACT

A trigger system having a detachable trigger shoe. The trigger shoe is made detachable from the trigger bow while the trigger bow remains in an installed state within the pistol. A selectable detachment feature is provided for the connection between the trigger shoe and the trigger bow. The user can activate this detachment feature and remove the shoe while leaving the trigger bow in place. The user can then install a different trigger shoe while the trigger bow remains in place.

20 Claims, 13 Drawing Sheets

MODULAR FIREARM TRIGGER SYSTEM

CROSS-REFERENCES TO RELATED APPLICATIONS

This application is a continuation of U.S. application Ser. No. 18/661,841. The parent application was filed on May 13, 2024. It listed the same inventor.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of firearms. More specifically, the invention comprises a modular trigger system that allows a user to remove and swap a trigger shoe without having to remove the rest of the trigger assembly.

2. Description of the Related Art

The present invention is particularly suitable for use in the "1911/2011 family" of pistols. The term "1911/2011 family" refers to pistols that are descended from the inventions of John Moses Browning. The Browning inventions were originally standardized by the United States Army as the Model M1911 pistol. The U.S. formal designation was "Automatic Pistol, Caliber. 45, M1911." This standardization evolved to the M1911A1. The entire line is customarily referred to by the simpler designation "1911."

There are several Browning patents describing the evolution of the design. The barrel/breech locking mechanism and automatic reloading system are described in U.S. Pat. No. 580,924 (1897). The trigger and safety mechanisms are described in U.S. Pat. No. 984,519 (1911) and U.S. Pat. No. 1,070,582 (1913). U.S. Pat. Nos. 580,924; 984,519; and 1,070,582 are hereby incorporated by reference. The internal components and operating principles of the embodiments described in these patents are well understood by those skilled in the art but-should any specific explanations be needed to supplement the reader's understanding-reference to the incorporated patents will provide the answer.

While the genius of the original Browning designs is beyond question, the 1911 was unquestionably showing its age by the end of the twentieth century. Newer designs-such as those patented by Gaston Glock-provided a much higher magazine capacity and more ergonomic gripping and actuating features (The Glock designs are described in U.S. Pat. Nos. 7,051,468 and 8,156,677, among others). Several designers have sought to update the 1911 design so that it could more effectively compete in the modern world. For example, Taran Tactical Innovations of Simi Valley California, U.S.A., has created a pistol known as the "TTI 2011 COMBAT MASTER" which includes the operating mechanisms of the 1911 while incorporating significantly updated features. STI International, Inc. of Georgetown, Texas, U.S.A. has created a pistol known as the "2011" also featuring many updated features. Other competitors have developed updated versions of the M1911 as well, and these have also been referred to as a "2011"-though one should note that STI International, Inc. (now named Staccato 2011, Inc.) has in fact registered a trademark for "2011" with the U.S. Patent and Trademark Office (U.S. Pat. No. 4,267,237).

"2011"-type pistols usually incorporate a double stack magazine giving a capacity of 17 to 20 rounds for a 9 mm cartridge. The products include many other innovative features, such as a soft polymer grip wrapped over a metal frame. The over-arching concept is to retain the 1911's reliable operating mechanisms while eliminating some known problems and adding other new and desirable features.

The present invention is well suited for application to the entire "1911/2011 family" of pistols. Accordingly, the disclosed embodiments are adapted for use in the 1911/2011 family. However, the reader should bear in mind that the invention could be applied to many other types and the invention is by no means limited to the specific embodiments disclosed. The following background descriptions are intended to provide the reader with a basic understanding of the internal components of a 1911/2011-type pistol—but only to the extent relevant to the trigger mechanism (and the disassembly required to swap the trigger mechanism).

FIG. 1 provides a left side elevation view of a pistol 10 conforming to the M1911A1 specification. Frame 12 is nearly always made of metal. It includes grip 18. Most of the operating components are mounted on the frame. Slide 14 reciprocates atop the frame. Barrel 16 is part of an assembly including slide 14 and other components.

Trigger shoe 30 is the exposed portion of the trigger assembly. It rests within trigger area 94—an area surrounded by trigger guard 78. In the case of a 1911/2011, the trigger guard is an integral part of frame 12. The user presses against the forward-facing surface of the trigger shoe to fire the weapon. Pressing on this surface releases hammer 20 so that the hammer pivots forward and strikes the rear of the firing pin contained within the slide assembly. The main spring is contained within main spring housing 32. The main spring includes several branch "fingers" for biasing the sear and other components.

Slide stop 34 locks the slide in its rearward position when the last round of a magazine is fired. Magazine release 28 is pressed to release a magazine so that it can be removed from the bottom of grip 18. In the version shown, magazine base 19 includes a forward-protruding portion that the user can easily grip to assist in pulling the magazine free of the magazine well. In other magazines a large gripping feature remains outside the grip.

The 1911 includes highly-effective safety features that have greatly contributed to the pistol's acceptance for military and police use. In such applications, the pistol is usually carried with a round in the chamber and the hammer fully cocked. The 1911 includes two independent features to prevent an accidental discharge. First, grip safety 24 is spring-biased to block the actuation of the trigger mechanism unless a user is squeezing the pistol's grip. Second, pivoting thumb safety 22 can be pivoted upward by the user to a safe position in which the thumb safety (1) locks the slide so that it cannot move rearward, (2) locks the sear so that it cannot disengage the hammer, and (3) locks the hub of the hammer itself so that the hammer cannot pivot. These latter two actions prevent the firing of the weapon even if the weapon is dropped and even if the exposed hammer itself is struck by a substantial blow. Any modification to the 1911/2011 trigger system preferably retains all these features—as they are in large measure responsible for the design's continued popularity.

FIG. 2 provides an exploded view depicting some of the components contained within the pistol of FIG. 1. Many other components are in fact present in an operational pistol. It is helpful to establish a reference system for directional terms used in describing these components, since a pistol can obviously be reoriented as desired. The reference system will assume that the pistol is held in the hand, ready to fire, with the barrel oriented horizontally. The term "forward" shall mean moving in the direction from the firing chamber toward the muzzle of the barrel (which could also be stated as moving in the direction from rear sight 25 to front sight 27). The term "rearward" will be the opposite. Grip 18 descends from the balance of frame 12 in the downward direction. "Left" refers to the left side of the frame and "right" refers to the right side of the frame. The forward end of the pistol overall means the area proximate the muzzle of barrel 16. The rearward end of the pistol overall means the region proximate hammer 20 and grip safety 24.

FIG. 2 shows only the major components that must be removed in a 1911/2011 pistol in order to change the trigger. When a user desires to change a prior art trigger, the user clears the firearm by removing the cartridge magazine from magazine well 23 and cycling the slide 14 to ensure that any cartridge in the firing chamber is ejected. Once the firearm is cleared, the user pulls slide 14 to the disassembly position and removes slide stop 34 laterally. The slide assembly (including the barrel, the barrel return spring, the forward bushing, and other components) can then be pushed forward and free of frame 12.

The two detachable side grips on the grip of frame 12 are usually removed next (It is not strictly necessary to remove these grips in order to remove the trigger assembly in many cases but it does make the operation easier and so most users will remove the side grips). Magazine release 28 is removed. Thumb safety 22 is removed. The hammer-along with its connected main spring strut 36 is removed. Grip safety 24 is removed. Main spring housing 32 and its associated springs are next removed. With all these other components removed, the trigger assembly—including trigger shoe 30 and trigger bow 38—slides out the rear of frame 12 in the direction indicated by the arrow.

FIG. 3 provides a perspective view of a prior art trigger assembly 40. The assembly has two main components-trigger bow 38 and trigger shoe 30. In order to fire the weapon, the user presses the pad of an index finger on the forward-facing surface of trigger shoe 30. Thus, the shape and texture of the trigger shoe is important.

The trigger bow transmits the force of the user's trigger finger rearward to the firing mechanism. The term "firing mechanism" means the mechanism that propels a firing pin into a cartridge in the firing chamber in order to ignite the cartridge. For a 1911/2011 pistol, the firing mechanism includes a hammer in a cocked position that is released by a sear. It also includes a disconnector that selectively permits the rear of the trigger bow to contact the sear.

Attachment 42 rigidly connects the forward portion of trigger bow 38 to trigger shoe 30. The attachment should be rigid and durable. Prior art examples include brazed joints, a fastener-connected joint, a joint created by an overmolding process, etc. The trigger shoe is permanently attached to the trigger bow using one of these examples.

Right side rail 44 and left side rail 46 carry the trigger forces rearward to cross bar 48. It is the cross bar that actually urges the disconnector rearward into the lower tang of the sear during the firing cycle of a 1911. The trigger bow must be stiff and durable. It is usually made of a suitable metal-such as steel.

As explained previously, the trigger assembly slides into a 1911/2011 frame from the rear. FIGS. 4 and 5 provide a rear elevation view of frame 12. FIG. 4 shows frame 12 with its descending grip 18. Right channel 50 and left channel 52 run horizontally through the frame. Looking at FIG. 3, right side rail 44 is a close sliding fit within right channel 50 and left side rail 46 is a close sliding fit within left channel 52. FIG. 5 shows the prior art trigger assembly resting within right channel 50 and left channel 52. Cross-bar 48 is the rear-most portion of the trigger assembly.

Looking again at FIG. 3, the reader will note that the two side rails of the trigger bow 38 come together proximate attachment 42. Cross-bar 48 joins the two side rails proximate the rear. The hollow center between the two side rails provides room for the cartridge magazine, which slides upward through the open space of the magazine well. The inward-facing surfaces of the two side rails lie approximately parallel with the inward-facing surfaces of the magazine well of the frame. Once installed, trigger assembly 40 is free to move forward and rearward to a small extent sufficient to fire the weapon when the user presses the trigger shoe. The forward limit of motion is established by the forward part of the trigger bow 38 bearing against the internal surfaces of the pistol frame (A bendable tab or other protrusion is sometimes provided on a forward-facing portion of the trigger bow in order to adjust the limit of forward travel for the trigger assembly). The rearward limit of motion for the trigger assembly is established by cross-bar 48 bearing against portions of the trigger or safety mechanisms (typically the grip safety or the disconnector in the case of a 1911/2011). However, once the grip safety, hammer, etc. is removed as shown in FIG. 2, the entire trigger assembly freely slides out the rear of the frame.

The reader will thus appreciate that the motion of a prior art 1911/2011 trigger assembly is constrained by the frame and other mechanisms of the pistol. As shown in FIG. 2, the prior art trigger assembly must be removed from the rear of the pistol frame after many other components have been disassembled. This is an unfortunate constraint, because a 1911/2011 user often wishes to change the trigger shoe in situations where it is undesirable to disassemble the pistol. As an example, a user may wish to engage in a target-shooting exercise where a target flat-faced trigger shoe is preferred. Once the target-shooting exercise is completed the user may wish to change to a curved-face duty trigger shoe. The prior art 1911/2011 trigger allows these changes to be made, but only with the disassembly of the pistol. It would be preferable to provide a system wherein the trigger shoe can be changed without disassembling the pistol. The present invention provides such a solution.

BRIEF SUMMARY OF THE PRESENT INVENTION

The present invention comprises a trigger system having a detachable trigger shoe. The inventive system is well-suited to 1911/2011-style pistols. The trigger shoe is made detachable from the trigger bow while the trigger bow remains in an installed state within the pistol. A selectable detachment feature is provided for the connection between the trigger shoe and the trigger bow. The user can activate this detachment feature and remove the shoe while leaving the trigger bow in place. The user can then install a different trigger shoe while the trigger bow remains in place without any further disassembly of the firearm.

REFERENCE NUMERALS IN THE DRAWINGS

Figure 1:
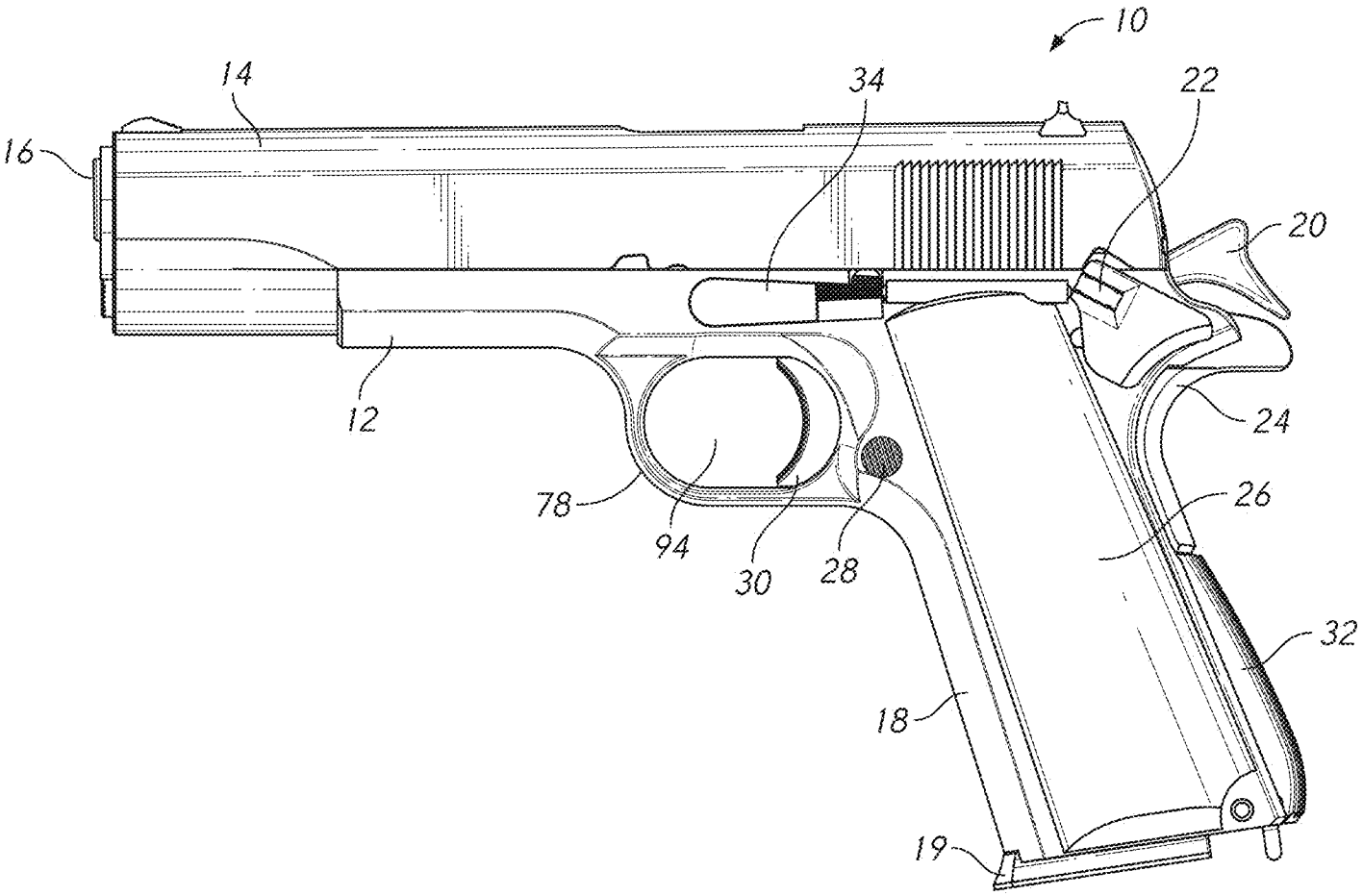
FIG. 1 (Prior Art)
FIG. 1 is a side elevation view, showing an exemplary prior art 1911 pistol.
Figure 2:
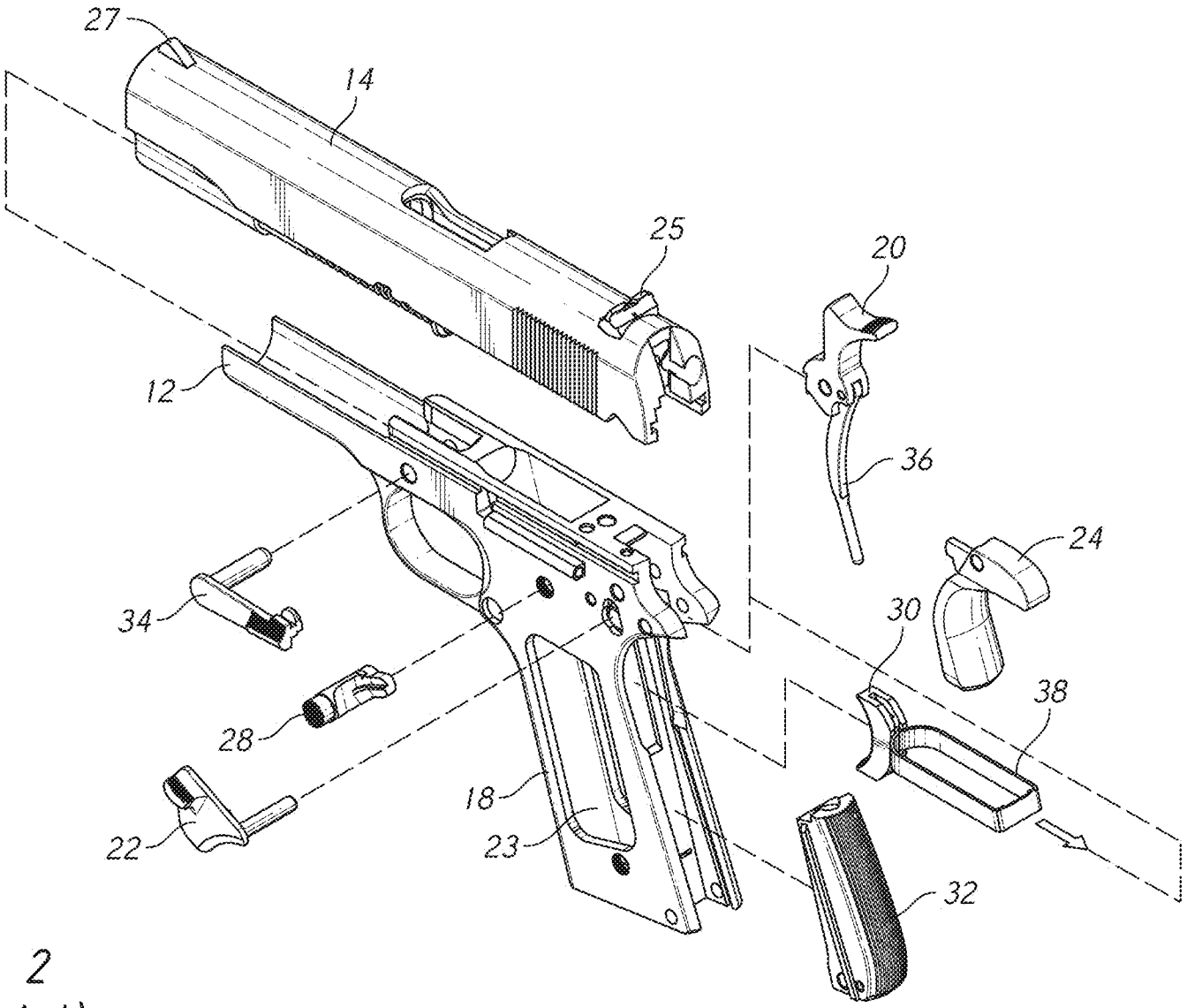
FIG. 2 (Prior Art)
FIG. 2 is an exploded perspective view, showing the pistol of FIG. 1 in a partially disassembled state.
Figure 3:
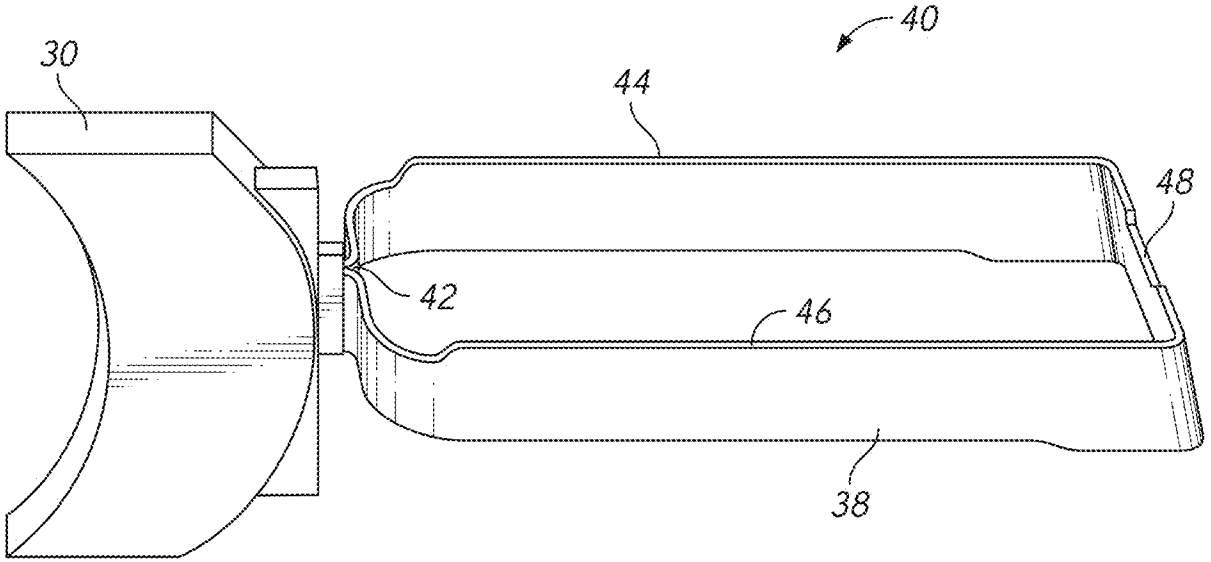
FIG. 3 (Prior Art)
FIG. 3 is a perspective view, showing a prior art trigger assembly.
Figure 5:
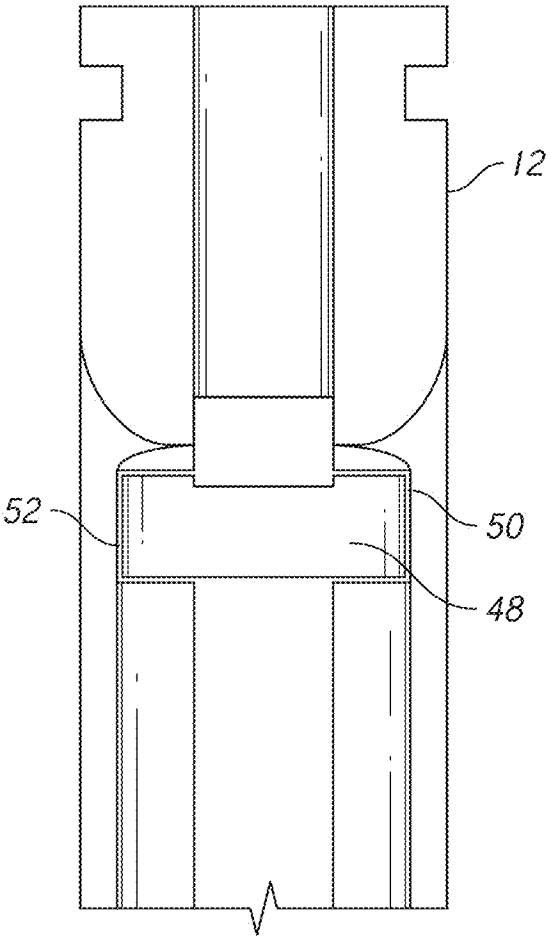
FIG. 5 (Prior Art)
FIG. 5 is a rear elevation view, showing the frame of FIG. 4 with the addition of a prior art trigger assembly.
Figure 4:
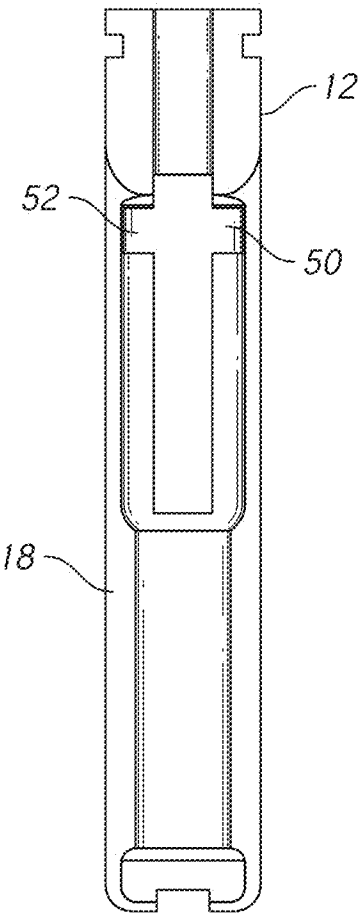
FIG. 4 (Prior Art)
FIG. 4 is a rear elevation view, showing the frame of the pistol of FIG. 1.

10 pistol
12 frame
14 slide
16 barrel
18 grip
19 magazine base
20 hammer
22 thumb safety
23 magazine well
24 grip safety
25 rear sight
26 grip
27 front sight
28 magazine release
30 trigger shoe
32 main spring housing
34 slide stop
36 strut
38 trigger bow
40 trigger assembly
42 attachment
44 right side rail
46 left side rail
48 cross-bar
50 right channel
52 left channel
54 trigger assembly
56 trigger shoe
58 slot
60 hole
62 hole
64 opening
65 opening
66 tang
67 joined surfaces
68 neck
70 snap protrusion
72 trigger bow
74 rear wall
76 rear edge
78 trigger guard
80 arcuate surface
82 arcuate surface
84 forward portion
86 forward portion
88 overtravel stop screw
90 hex receiver
92 access bore
94 trigger area
96 snap protrusion
98 opening
100 opening
102 slot
104 tang
106 snap protrusion
108 opening

DETAILED DESCRIPTION OF THE INVENTION

The following descriptions pertain to preferred embodiments of the present invention, which are particularly adapted to a 1911/2011 pistol. Those skilled in the art, having reviewed this disclosure, will easily envision many other embodiments beyond those illustrated. Thus, the scope of the invention should be set by the claims rather than the examples given.

Figure 6:
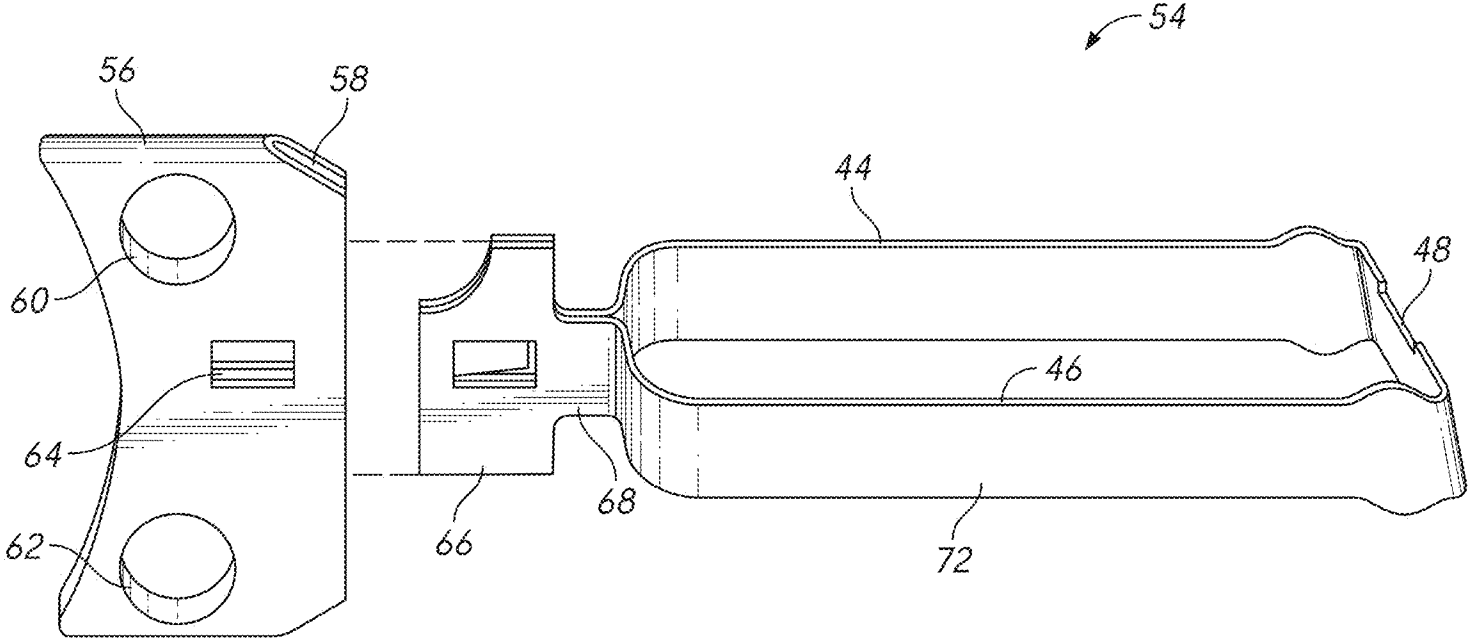
FIG. 6 is an exploded perspective view, showing a trigger assembly made according to the present invention.

FIG. 6 is an exploded perspective view, illustrating a trigger assembly 54 made according to the present invention. As for the prior art, the assembly includes a trigger bow 72 and a trigger shoe 56. However, in the inventive embodiments, the trigger shoe is attached to the trigger bow by a selectable detachment feature. This feature allows the trigger shoe to be removed and replaced while the trigger bow remains in the pistol in an assembled state.

Trigger bow 72 includes right side rail 44, left side rail 46, and cross-bar 48. These three components 44,46,48 are the same as for the prior art trigger bow 38. The forward portion of inventive trigger bow 72 is different, however. In this example, the two side rails come together in neck 68. Tang 66 extends forward from this region. Trigger shoe 56 includes a rearward-opening slot 58. Slot 58 is sized to be a close sliding fit over tang 66.

The trigger shoe includes opening 64, which forms part of the selectable detachment feature. Holes 60,62 are also provided in this example. The forward-facing surface of the trigger shoe will often include ridges, diamond checkering, or other grip-enhancing features that suit the preferences of a particular user. These features are well known in the art and have thus not been illustrated.

Figure 7:
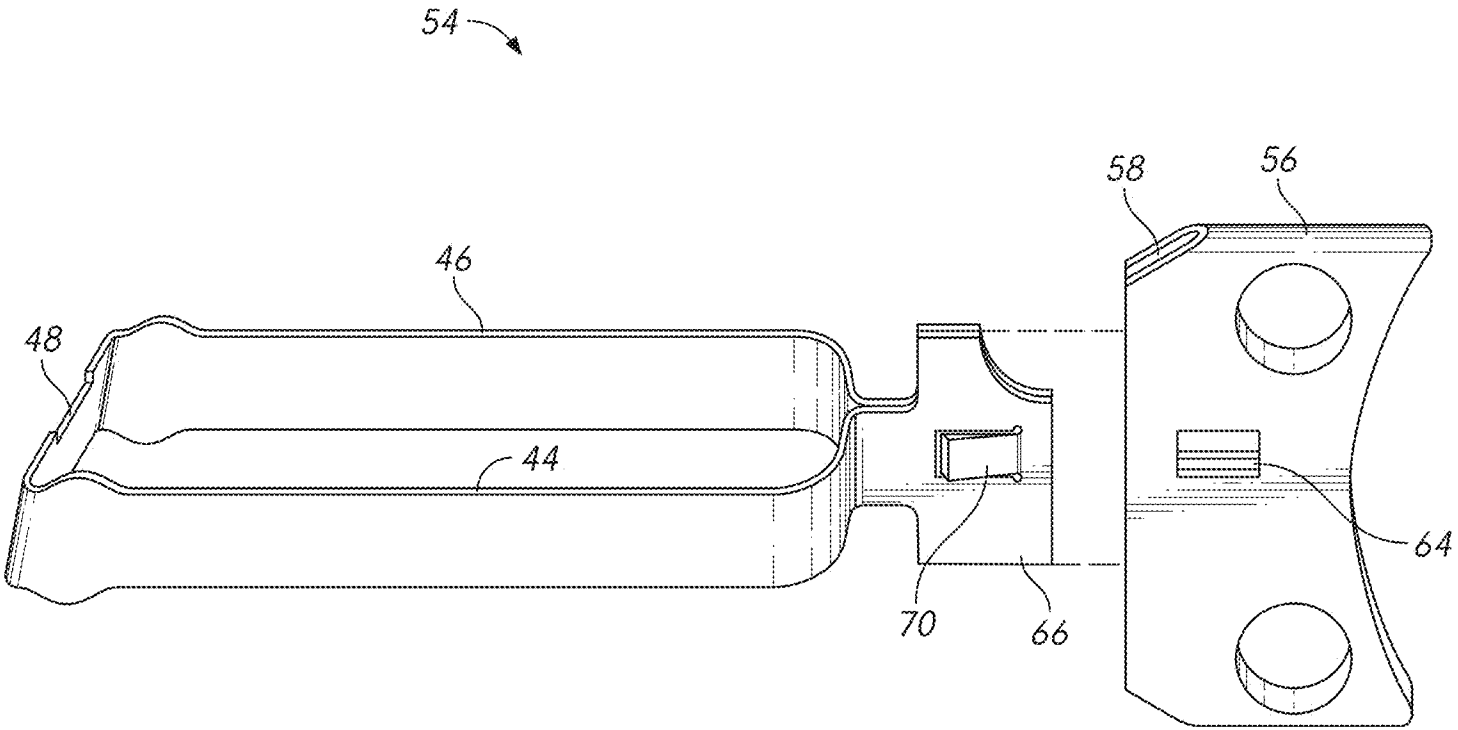
FIG. 7 is an exploded perspective view, showing the opposite side of the trigger assembly of FIG. 6.

FIG. 7 shows the assembly of FIG. 6 from the opposite side. The reader will note how snap protrusion 70 protrudes laterally from tang 66. The snap protrusion is resilient, so that it can be "pinched" inward without producing plastic deformation. The resilience can be realized in a variety of ways. One approach is to make the snap protrusion and tang out of a resilient material—such as thin steel, so that the resilience is inherent. Another approach is to provide an insert in the location of the snap protrusion with a separate spring element.

Looking at FIG. 7, the reader will note that the forward portion of snap protrusion 70 lies flush with the outer lateral surface of tang 66 itself, while the rearward portion protrudes outward. This provides a unidirectional latching function. When trigger shoe 56 is moved over tang 66, the tang moves into slot 58 and the rearward portion of snap protrusion 70 is forced inward. As the trigger shoe continues to move rearward the rearward edge of snap protrusion 70 enters opening 64 and the snap protrusion then "pops" outward into opening 64. This creates a mechanical interference that prevents the trigger shoe being pulled forward off of tang 66.

Figure 8:
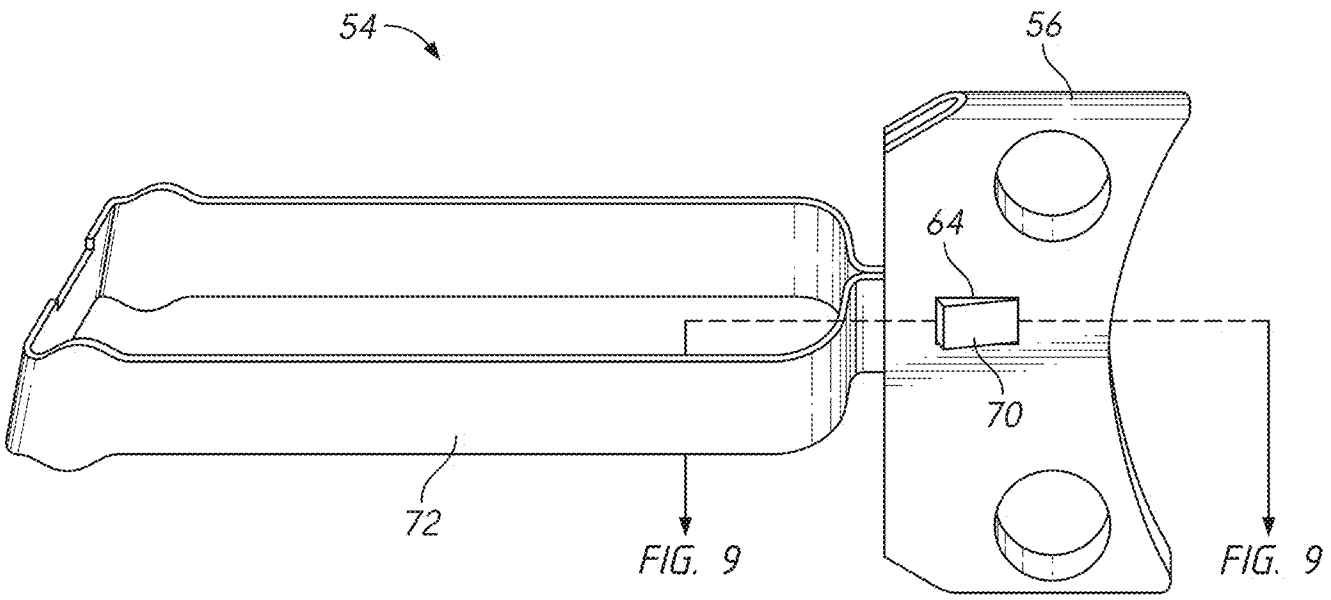
FIG. 8 is a perspective view, showing the assembly of FIG. 7 in an assembled state.

FIG. 8 shows the assembly of FIG. 7 in an assembled state. The reader will note how snap protrusion 70 has popped out into opening 64. This action secures trigger shoe 56 to trigger bow 72. In order to release this selectable detachment feature, the user must press inward on the rearward portion of snap protrusion 70 and hold it in while moving trigger shoe 56 forward and away from the trigger bow.

Figure 9:
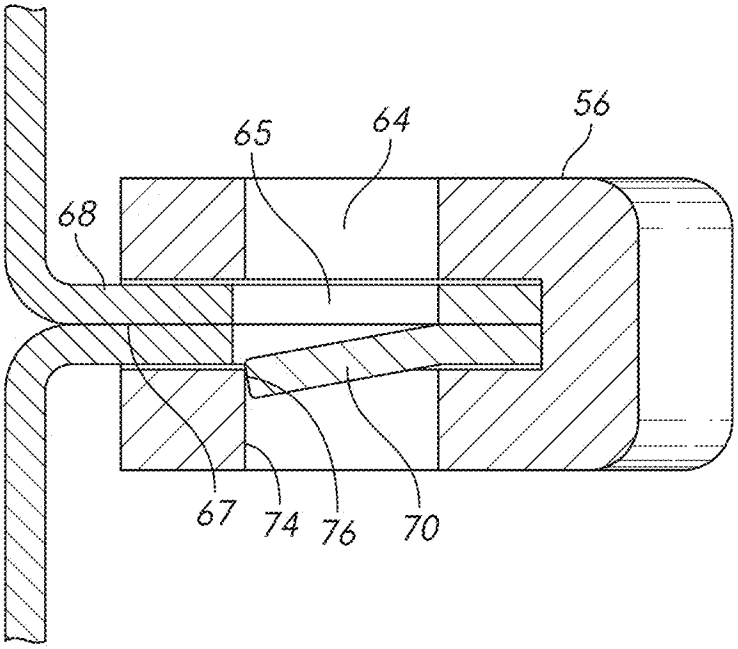
FIG. 9 is a partial sectional plan view, showing an embodiment of the selectable detachment feature

FIG. 9 shows a detailed sectional view through the region of the selectable detachment feature (note the position and orientation of the "callouts" for FIG. 9 in FIG. 8). In this embodiment snap protrusion 70 is made of the same material as the rest of the trigger bow. The trigger bow is made of thin and resilient material. Three sides of the rectangular snap protrusion are separated from the rest of the tang by piercing operations. One side remains attached. The tang itself is created in this example by joining together two thicknesses of the trigger bow material along joined surface 67. Opening 65 is provided in one of the thicknesses and snap protrusion 70 is formed in the other—with the snap protrusion being plastically deformed outward to create the resting state shown in FIG. 9.

In the resting state shown in FIG. 9, rear edge 76 of snap protrusion 70 has snapped outward until it lies in front of rear wall 74 of opening 64. If the user attempts to disconnect trigger shoe 56 by pulling it forward (to the right in the view), the interference between rear wall 74 and rear edge 76 will prevent this movement. The trigger shoe cannot move to the rear (left in the orientation shown in the view) because the forward edge of the tang is hard against the boundary of the slot in the trigger shoe. Thus, the trigger shoe is secured. In order to remove the trigger shoe, the user must press the rear portion of snap protrusion 70 inward until rear edge 76 clears rear wall 74 and hold it there while sliding the shoe forward.

Figure 10:
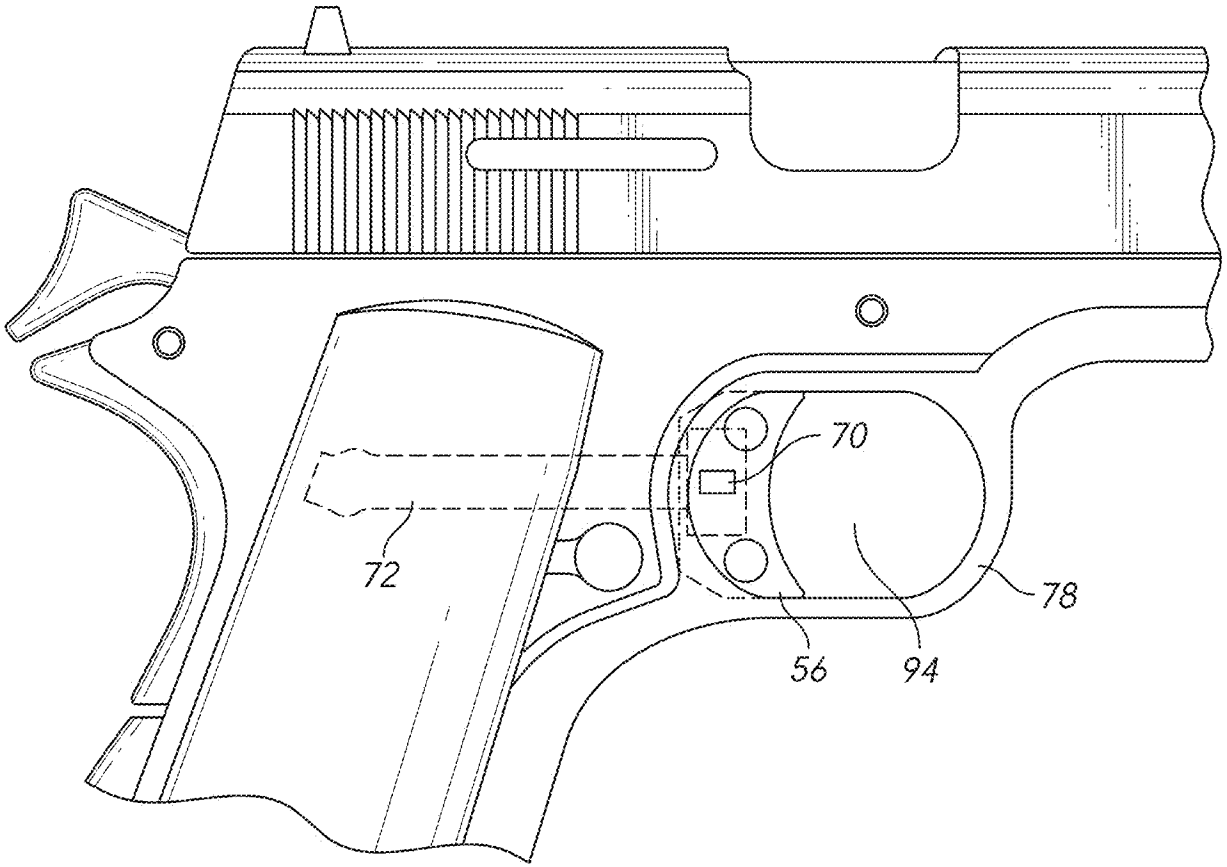
FIG. 10 is a right side elevation view, showing the inventive trigger assembly installed in a prior art pistol.

FIG. 10 shows a right-side elevation view of the inventive trigger assembly installed in a 1911/2011 pistol. Trigger shoe 56 rests within trigger area 94 inside trigger guard 78. A portion of the trigger shoe is exposed but the rear portion of the trigger shoe is contained within the frame (as for the prior art). The rear portion of the shoe is shown in hidden lines. The outline of trigger bow 72 is also shown in hidden lines so that the reader can readily appreciate its position and orientation within the frame.

In the state shown, the user grips the pistol and squeezes the trigger as for the prior art designs. The detachable nature of the trigger shoe does not affect its operation. However, when the user wishes to detach the trigger shoe, he or she presses inward on the rear portion of snap protrusion 70—which is accessible as shown in FIG. 10. A pointed object is preferably used to push the snap protrusion inward. The tip of a pen works well for this. The tip of a hex key or a small screwdriver also works well.

Figure 11:
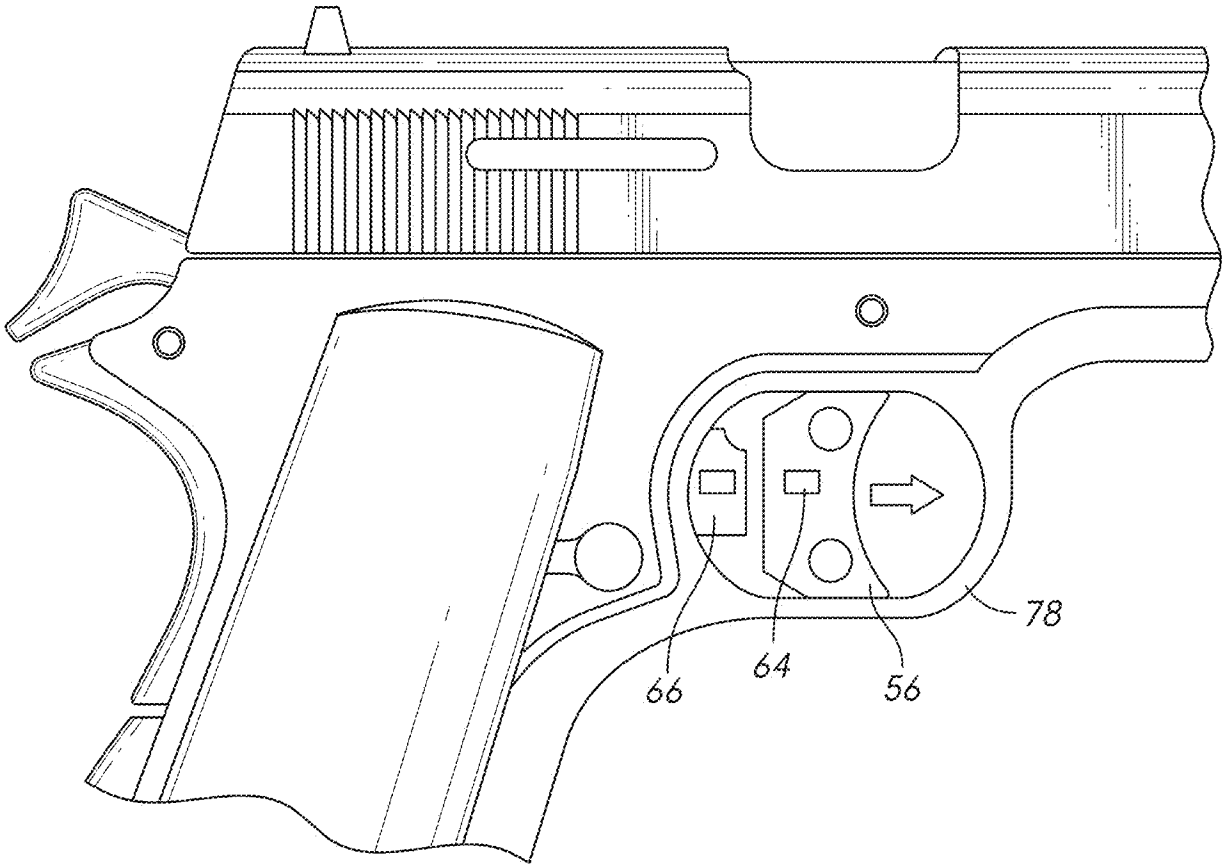
FIG. 11 is a right side elevation view, showing the removal of the inventive trigger shoe.

FIG. 11 shows the completion of the removal process. Once the snap protrusion is out of engagement with opening 64 the user can pull trigger shoe 56 forward and free of tang 66. Sufficient room exists within trigger guard 78 to allow the trigger shoe to be moved laterally and away from the pistol. A separate trigger show containing the same type of selectable detachment feature can then be attached to the tang and used. The pistol should obviously be cleared before changing the trigger shoe. The hammer is shown cocked in FIGS. 10 and 11. The position of the hammer is irrelevant to the trigger shoe swap.

Figure 12:
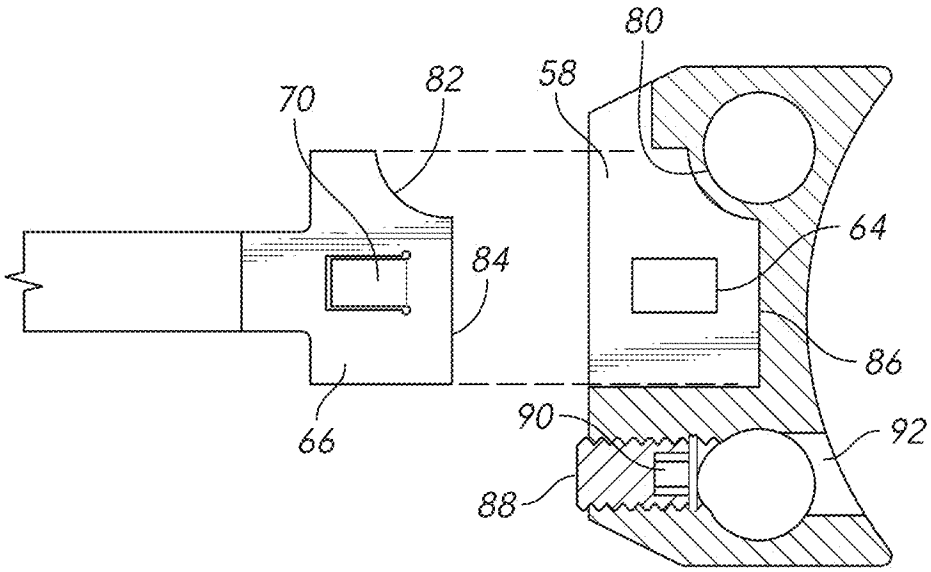
FIG. 12 is a sectional elevation view, showing another embodiment of the inventive trigger shoe and trigger bow.

FIG. 12 provides an elevation view of the tang and trigger shoe with a section being taken through the middle of the trigger shoe in order to reveal internal details. It is important for the trigger shoe to be solidly attached to the tang when installed. In the embodiment shown, snap protrusion 70 and opening 64 are located so that forward portion 84 of tang 66 bears against forward portion 86 of slot 58 when the snap protrusion engaged opening 64. Arcuate surface 82 likewise bears against arcuate surface 80 of slot 58 when the trigger shoe is in the installed state. The interactions of these surfaces prevent any vertical or forward/rearward motion. Left/right motion is inhibited by the left and right outward-facing walls of the tang being a close sliding fit within the left and right walls of slot 58.

Another desirable feature is shown for the embodiment of FIG. 12. Many 1911/2011 users prefer a trigger assembly with minimal travel. These users wish to limit the amount of continued rearward travel for the trigger shoe after the firing mechanism has been actuated. The amount of rearward travel past the point where the firing mechanism has been actuated is known as "overtravel." An adjustable overtravel stop screw 88 is provided for this purpose. The overtravel stop screw is threaded into a threaded bore within the trigger shoe. Hex receiver 90 is provided in the set screw. An allen key or similar tool can be engaged to this hex receiver in order to turn the overtravel stop screw. Access bore 92 provides access for the adjustment tool. The rearward extreme of the overtravel stop screw contacts the pistol's frame and limits further rearward travel of the trigger assembly. The user can vary the amount of "overtravel" by turning the overtravel stop screw 88.

The reader will therefore appreciate that the present invention provides a trigger assembly where the trigger shoe can be detached from the trigger bow and a second trigger shoe can be attached-all while the trigger bow remains installed within the firearm. Other features can be provided and combined in different embodiments, including the following:

1. The use of differing shapes for the interfacing surfaces between the tang and the slot in the trigger shoe;
2. The use of a separate insert for the selectable detachment feature-such as a spring metal inset that is pressed laterally into the tang;
3. The location of a snap feature on the trigger shoe interacting with a fixed opening on the tang; and
4. The provision of a rearward protruding tang on the trigger shoe that engages a slot on the trigger bow.

Figure 13:
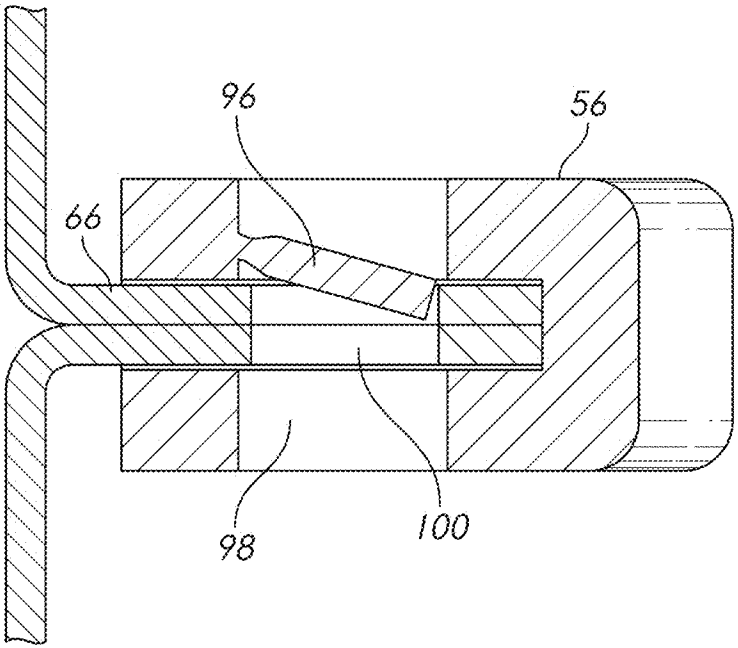
FIG. 13 is a sectional plan view, showing an alternate embodiment for the selectable detachment feature.
Figure 14:
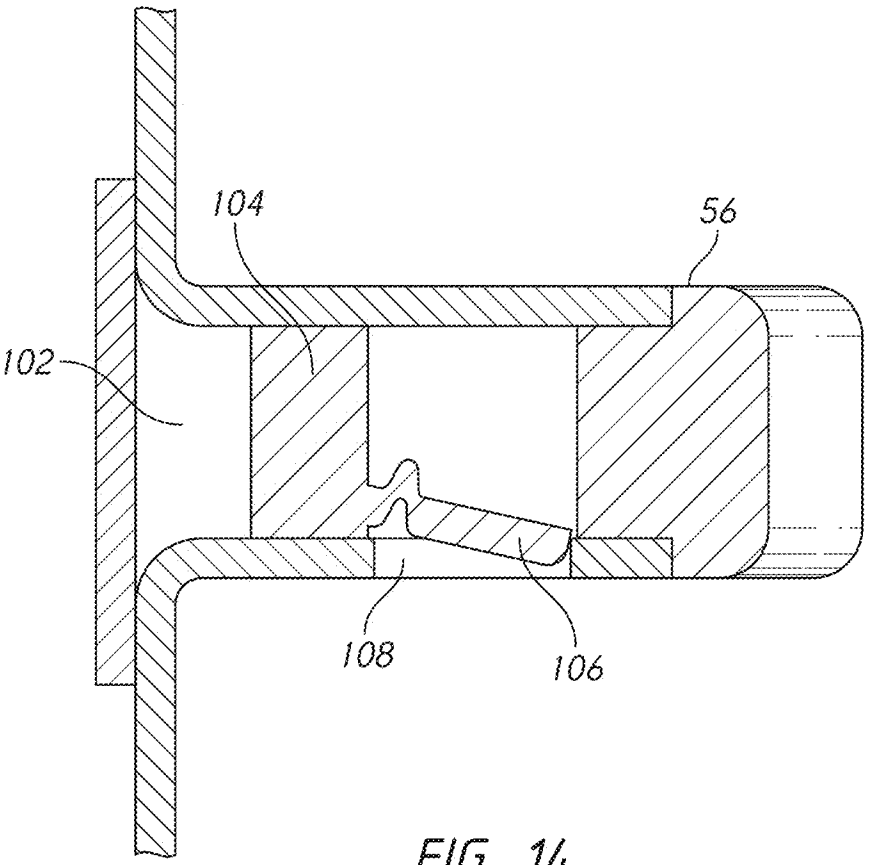
FIG. 14 is a sectional plan view, showing an alternate embodiment for the selectable detachment feature.

Two of these additional embodiments are shown in FIGS. 13 and 14. In the version of FIG. 13, snap protrusion 96 is part of trigger shoe 56 rather than tang 66. As the trigger shoe is urged rearward over tang 66, snap protrusion 96 pos into opening 100 through tang 66. The user can release the engagement by inserting an object through opening 98 and pressing snap protrusion 96 out of engagement.

In the version of FIG. 14, slot 102 is provided on the trigger bow and tang 104 is provided on the rearward part of trigger shoe 56. As tang 104 is urged rearward into slot 102 snap protrusion 106 pops out into opening 108. The user can release the engagement by pressing inward on snap protrusion 106.

Although the preceding descriptions contain significant detail, they should not be construed as limiting the scope of the invention but rather as providing illustrations of the preferred embodiments of the invention. Those skilled in the art will know that many other variations are possible without departing from the scope of the invention. Accordingly, the scope of the invention should properly be determined with respect to the following claims rather than the examples given.

Having described my invention, I claim:

1. A pistol, comprising:
(a) a frame, having a forward end and a rearward end;
(b) said frame including a grip and a magazine well;
(c) said frame including a left channel running along a left side of said magazine well, said left channel being open in the rear and closed in the front;
(d) said frame including a right channel running along a right side of said magazine well, said left channel being open in the rear and closed in the front,
(e) a trigger guard enclosing a trigger area;
(f) a firing mechanism;
(g) a trigger bow, including,
(i) a right side rail,
(ii) a left side rail,
(iii) a cross-bar connecting a rear portion of said right side rail to a rear portion of said left side rail,
(iv) a neck connecting a front portion of said right side rail to a front portion of a left side rail,
(v) a tang protruding forward from said neck;
(h) said trigger bow slidably received within said frame with said right side rail resting in said right channel, said left side rail resting in said left channel, and said cross-bar lying proximate said firing mechanism;
(i) said tang of said trigger bow extending into said trigger area:
(j) a trigger shoe attached to said trigger bow;
(k) a selectable detachment feature selectively attaching said trigger shoe to said trigger bow;
(l) wherein said selectable detachment feature comprises:
an opening in said trigger shoe; and
a resilient snap protrusion extending laterally from said tang and into said opening in said trigger shoe.

2. The pistol as recited in claim 1, wherein said trigger shoe comprises a slot sized to receive said tang, so that said trigger shoe can slide over said tang.

3. The pistol as recited in claim 1, wherein said resilient snap protrusion is accessible through said opening in said trigger shoe, so that a user can depress said snap protrusion and thereby release said snap protrusion form said opening in said trigger shoe.

4. The pistol as recited in claim 2, wherein said resilient snap protrusion is accessible through said opening in said trigger shoe, so that a user can depress said snap protrusion and thereby release said snap protrusion form said opening in said trigger shoe.

5. The pistol as recited in claim 3, wherein said opening in said trigger shoe resides in said trigger area when said trigger shoe is installed on said trigger bow.

6. The pistol as recited in claim 1, wherein said trigger shoe further comprises an adjustable overtravel set screw.

7. The pistol as recited in claim 1, wherein said trigger shoe can be attached to said trigger bow in one of two selectable orientations.

8. A pistol, comprising:
(a) a frame, having a forward end and a rearward end;
(b) said frame including a grip and a magazine well;
(c) a trigger guard enclosing a trigger area;
(d) a firing mechanism;
(e) a trigger bow, including a rear portion and a forward portion;
(f) said trigger bow slidably received within said frame with said rear portion being positioned to activate said firing mechanism;
(g) a trigger shoe slidably engaged to said forward portion of said trigger bow;
(h) a selectable detachment feature selectively attaching said trigger shoe to said forward portion of said trigger bow, so that said trigger shoe can be removed from said trigger bow;
(i) wherein said selectable detachment feature comprises:
a resilient snap protrusion engaging between said trigger shoe and said trigger bow; and
wherein said snap protrusion is accessible so that a user can depress said snap protrusion and thereby release said trigger shoe from said trigger bow.

9. The pistol as recited in claim 8, wherein said trigger shoe comprises a slot sized to receive a tang on said trigger bow, so that said trigger shoe can slide over said tang.

10. The pistol as recited in claim 9, wherein said selectable detachment feature comprises:
(a) an opening in said trigger shoe; and
(b) said resilient snap protrusion protruding laterally from said forward portion of said trigger bow and into said opening in said trigger shoe.

11. The pistol as recited in claim 10, wherein said resilient snap protrusion is accessible through said opening in said trigger shoe, so that a user can depress said snap protrusion and thereby release said snap protrusion form said opening in said trigger shoe.

12. The pistol as recited in claim 11, wherein said opening in said trigger shoe resides in said trigger area when said trigger shoe is installed on said trigger bow.

13. The pistol as recited in claim 8, wherein said trigger shoe further comprises an adjustable overtravel set screw.

14. The pistol as recited in claim 8, wherein said trigger shoe can be attached to said trigger bow in one of two selectable orientations.

15. A trigger assembly for use in a pistol having a frame, a trigger guard, a trigger area within said trigger guard, and a firing mechanism, comprising:
(a) a trigger bow having a forward portion and a rear portion;
(b) said trigger bow slidably received within said frame with said rear portion being positioned to activate said firing mechanism;
(c) a trigger shoe that is selectably attached to said forward portion of said trigger bow by a selectable detachment feature; and
(d) said selectable detachment feature being a resilient snap protrusion engaging between said trigger shoe and said trigger bow, wherein said snap protrusion is accessible so that a user can depress said snap protrusion and thereby release said trigger shoe from said trigger bow.

16. The trigger assembly as recited in claim 15, wherein said trigger shoe comprises a slot and said forward portion of said trigger bow comprises a tang sized to fit within said slot, so that said trigger shoe can slide over said tang.

17. The trigger assembly as recited in claim 16, wherein said selectable detachment feature further comprises:

(a) an opening in said trigger shoe; and (b) said resilient snap protrusion protruding laterally from said tang and into said opening in said trigger shoe.

18. The trigger assembly as recited in claim 17, wherein said resilient snap protrusion is accessible through said opening in said trigger shoe, so that a user can depress said snap protrusion and thereby release said snap protrusion from said opening in said trigger shoe.

19. The trigger assembly as recited in claim 18, wherein said opening in said trigger shoe resides in said trigger area when said trigger shoe is installed on said trigger bow.

20. The trigger assembly as recited in claim 15, wherein said trigger shoe further comprises an adjustable overtravel set screw.

* * * * *